US005704139A

United States Patent [19]

Okajima

[11] Patent Number: 5,704,139

[45] Date of Patent: Jan. 6, 1998

[54] SNOWBOARD SHOES

[75] Inventor: Shinpei Okajima, Sakai, Japan

[73] Assignee: Shimano, Inc., Osaka, Japan

[21] Appl. No.: 579,648

[22] Filed: Dec. 27, 1995

[30] Foreign Application Priority Data

Dec. 28, 1994 [JP] Japan ..... 6-327195

[51] Int. Cl.[6] ..... A43B 5/04; A63C 9/02

[52] U.S. Cl. ..... 36/115; 36/117.3; 280/613

[58] Field of Search ..... 36/115, 116, 117.3; 280/613

[56] References Cited

U.S. PATENT DOCUMENTS

| | | | |
|---|---|---|---|
| 4,026,045 | 5/1977 | Druss | 36/117.3 |
| 4,284,292 | 8/1981 | Faulin | 36/117.3 |
| 5,035,443 | 7/1991 | Kincheloe | 280/618 |
| 5,474,322 | 12/1995 | Perkins et al. | 36/117.3 |
| 5,505,477 | 4/1996 | Turner | 36/117.3 |
| 5,595,396 | 1/1997 | Bourdeau | 280/607 |

FOREIGN PATENT DOCUMENTS

| | | | |
|---|---|---|---|
| WO 86/03983 | 7/1986 | WIPO | A63C 9/86 |
| WO 94/26365 | 11/1994 | WIPO . | |

OTHER PUBLICATIONS

European search report for EP 95309512.2, dated May 20, 1997.

*Primary Examiner*—M. D. Patterson
*Attorney, Agent, or Firm*—James A. Deland

[57] ABSTRACT

A sole for a snowboard boot includes a depression defined in the sole for attachment of a fastener and a recessed groove for providing a space which opens to the front of the boot for creating a through-passage between the space and the depression. The open space allows the boot to be easily attached to the snowboard while preventing direct contact between the fastener and the ground. A portion of the sole which includes the toe and recessed groove is more resilient than a remaining portion of the boot to further facilitate walking by allowing the sole to flex during walking.

6 Claims, 5 Drawing Sheets

SNOWBOARD SHOES

BACKGROUND OF THE INVENTION

The present invention is directed to snowboard boots and, more particularly, to a snowboard boot of the type which has a fastener affixed to a sole for fixing the boot to a snowboard.

A snowboard is mounted with the user's legs in a position such that sidewards leg movements largely transfer into forward and backward movements of the snowboard. The snowboard is also frequently leaned to the right and left in order to have the edges of the snowboard act on the snow surface. Many snowboard boots are affixed to the snowboard at the front of each boot. When the snowboarder with this kind of boot effects a leaning action by pressing down on the front of the boot and lifting the heel, the front of the boot exerts downward pressure on the snowboard and the force of this action is transferred to the snowboard relatively effectively. However, the heel of the boot tends to lift upward and off the snowboard, and this upward force does not transfer to the snowboard very well. In contrast, if the boots are fastened to the snowboard along the front and back of the boots, then the upward force of the heel is also effectively transferred to the snowboard. In other words, the downward force of the front of the boot and the upward force of the heel of the boot are both transferred to the snowboard, thus, making it easier to effect the leaning action of the snowboard.

In the past, some snowboard boots which were fastened to the snowboard at the front and back of the boot had soles that were directly fastened to the snowboard binding. Therefore, the soles functioned not only as soles but as the fasteners that directly fastened the boot to the snowboard binding. Such soles typically had to be very rigid in order to withstand the leaning forces generated while riding the snowboard. Thus, walking in the boom after removing the snowboard during mounting and demounting a ski lift was made difficult by the hard sole directly contacting the ground. Other boots, whose soles did not fasten directly to the snowboard, did not have this problem. These boots had buckle-type fasteners and relatively soft soles. Unfortunately, in addition to attaching the buckle-type fastener, a tightening adjustment had to be made as well in order to fasten the boots to the snowboard. This attachment and adjustment function, and the necessity of having to undo the buckles during mounting and demounting a ski lift, proved to be troublesome.

SUMMARY OF THE INVENTION

The present invention is directed to a snowboard boot which can accommodate a separate fastener recessed in the sole of the boot so that the fastener does not come in direct contact with the ground to facilitate walking while still allowing easy attachment to the snowboard, and which has a resilient front sole portion to further facilitate walking. In one embodiment of the present invention, a sole for a snowboard boot includes a depression defined in the sole for attachment of a fastener, and a recessed groove for providing a space which opens to the front of the boot for creating a through-passage between the space and the depression. The open space allows the boot to be easily attached to the snowboard while preventing direct contact between the fastener and the ground. A portion of the sole which includes the toe and recessed groove is more resilient than a remaining portion of the boot to further facilitate walking by allowing the sole to flex during walking. In a more specific embodiment, the sole includes a reinforcement plate for attachment of the fastener, wherein the reinforcement plate is disposed in portions of the sole except the portion of the sole which includes the toe and recessed groove.

DETAILED DESCRIPTION OF THE EMBODIMENTS

Figure 1:
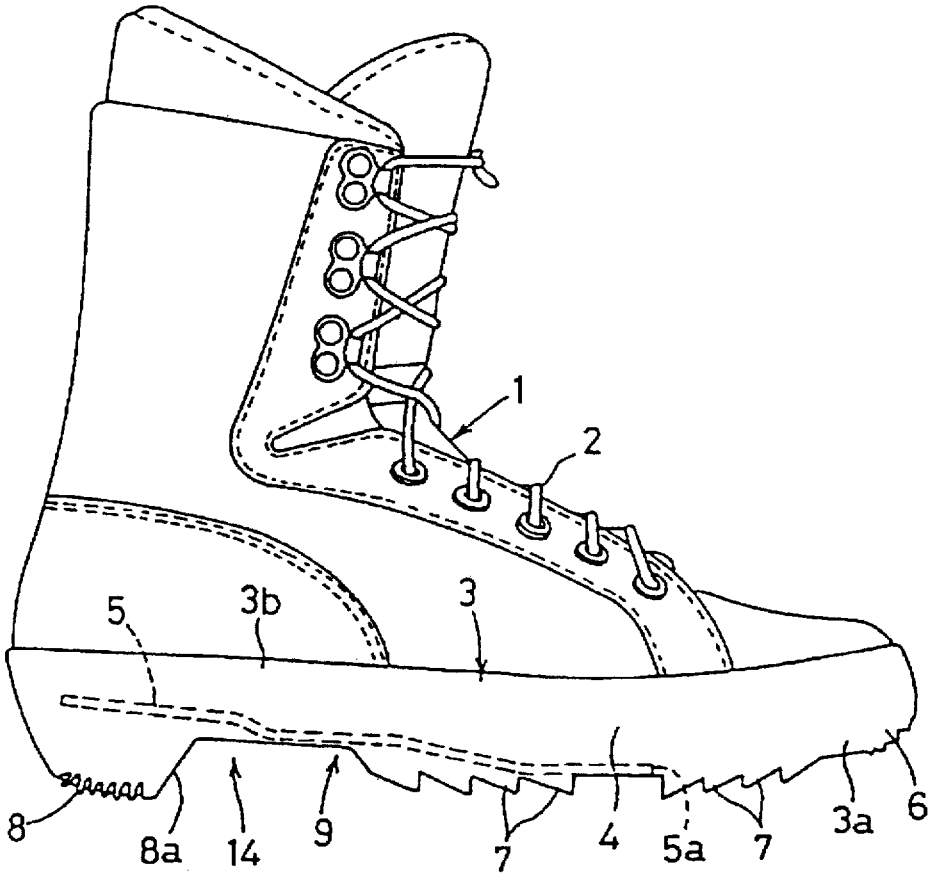
FIG. 1 is a side view of a particular embodiment of a snowboard boot according to the present invention.
Figure 2:
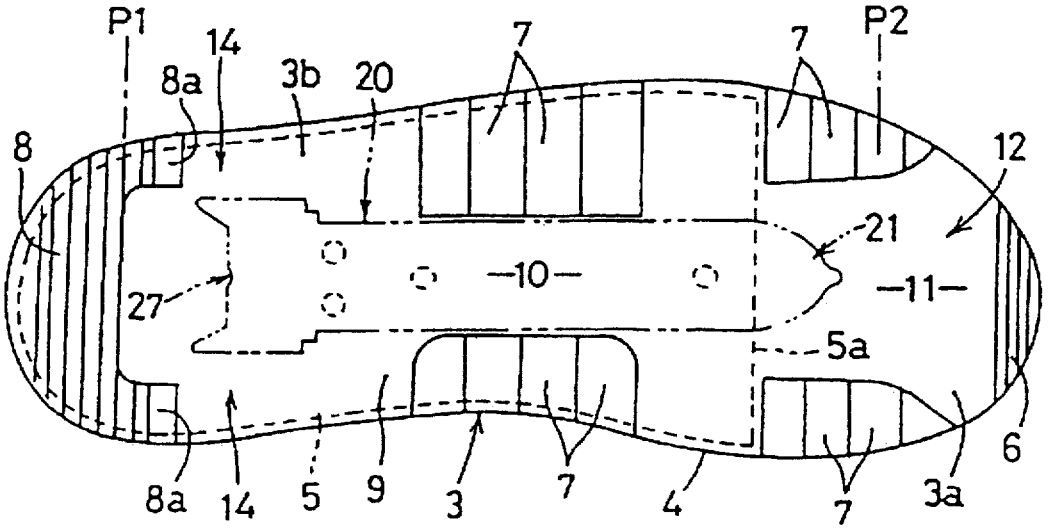
FIG. 2 is a bottom view of the snowboard boot shown in FIG. 1.

As shown in FIGS. 1 and 2, the boot (I) is constructed to tie in the feet to an upper 1 by a shoelace 2, (ii) is equipped with a sole 3, wherein this sole has an elastic outer sole 4 made of rubber, a plate sole 5 made from a plastic plate, a toe 6 which is bent upward, nonskid ridges 7 located between the toe 6 and a non-contact part 9 and formed in the above elastic outer sole 4, and a heel 8 formed in the above elastic outer sole 4, (iii) forms a bottom contact surface which comes into contact with the ground, when the sole 3 is placed over a flat ground surface, by the bottom surfaces of the tips of the above nonskid ridges 7 and the above heel 8, and (iv) is provided with a depression 10, wherein this depression is located on this bottom contact surface with a length extending from a point P1 on the sole 3, which is further towards the back of the boot than a non-contact part 9 to a point P2, which is slightly behind the toe 6, thus forming a long depression between the from and back of the boot for attaching a fastener.

Figure 3:
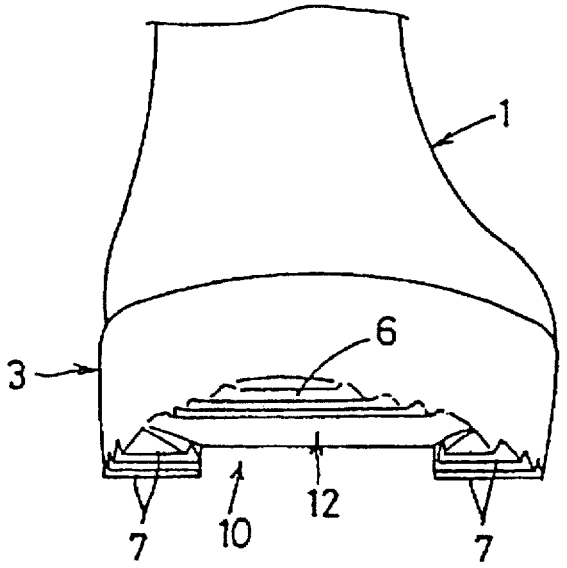
FIG. 3 is a front view of the sole shown in FIG. 1.

The snowboard boot is further constructed with a recessed groove 11 which is formed between the depression 10 and the toe 6 as an extension of the depression 10, and in addition, due to (I) the lateral sides of the above depression 10 and recessed groove 11 contacting the ground when the bottom contact surface of sole 3 comes into contact with a flat ground surface, and (ii) the toe 6 not contacting the ground because of its upward-bent design, the result is a space 12 that has a structure that opens frontally to the boot, as shown in FIG. 3, and that passes through to the above depression 10 via the recessed groove 11.

Figure 4:
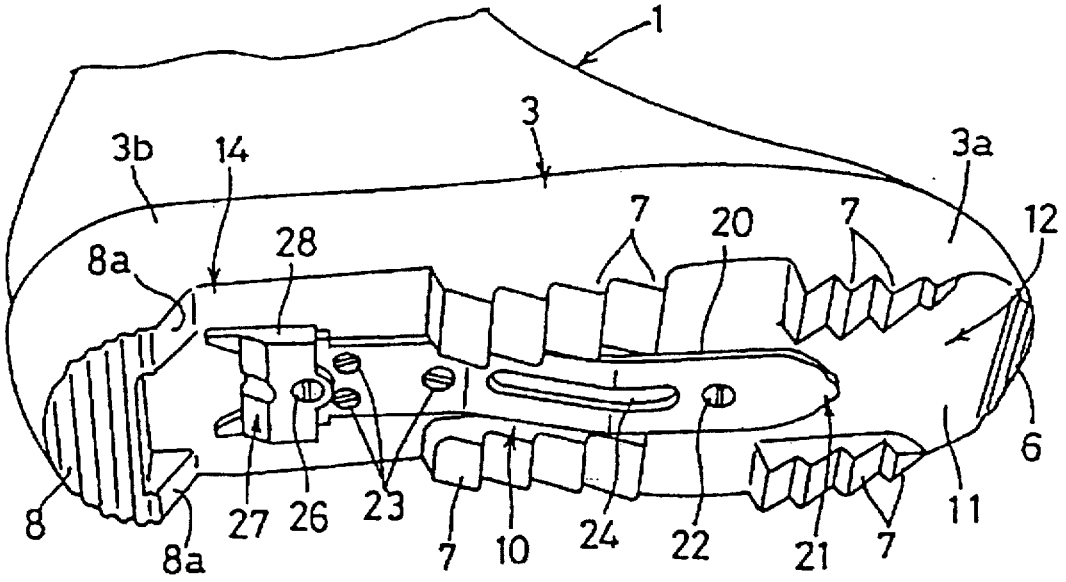
FIG. 4 is an oblique view of the sole showing a particular embodiment of a fastener according to the present invention.
Figure 5:
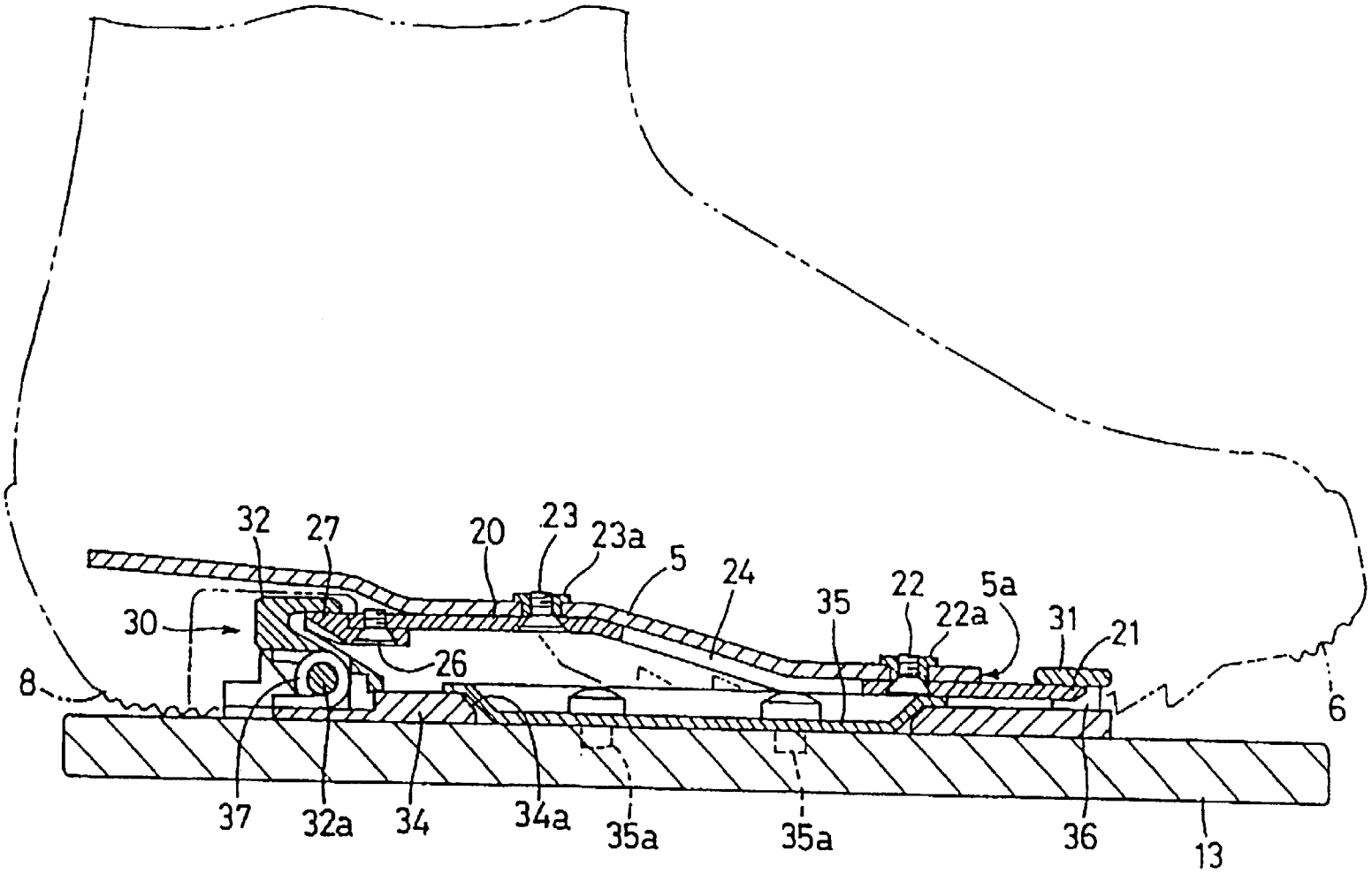
FIG. 5 is a side cross-sectional view of portions of the sole showing the attachment of the fastener to the snowboard binding.

This snowboard boot (I) has a fastener 20 attached at the above depression 10 therein, as shown in FIG. 4, (ii) is attached to the snowboard 13 at the sole 3 by this fastener 20 and a binding 30 attached to the snowboard 13, as shown in FIG. 5, and thus (iii) can be used for manipulating the snowboard 13. As shown in FIGS. 4 and 5, the above fastener 20 is formed by a metal plate fastener main body which fastens a frontal engagement component 21 with a fastening screw 26 towards the back of the fastener main body, wherein this fastener main body is a metal plate provided with a notch hole 24 located between the front and back ends.

If a suitable fastener 20 which matches the depth of the depression 10 is used, the fastener 20 can be attached to a sole 3 in a manner that it does not protrude beyond the surface of the sole that contacts the ground. By sliding the snowboard-mounted boot towards the from of the snowboard binding, the binding passes through the space 12 and recessed groove 11, and drops into the depression 10. Furthermore, when the boot is slid across in order effect the fastening action of the fastener 20, the tip passes over the binding, thus facilitating the binding to drop into the depression 10. In the case of bindings which fasten the fastener 20 by inserting the fastener 20 from the back, the fastener 20 and binding just snap into place. In the case of bindings which fasten the fastener 20 by a stepping in motion from above, the fastener 20 and the binding are fashioned W be placed into position with respect to each other, and simply stepping in will complete the fastening.

The above depression 10 (I) is formed as a long depression between the from and back sides of the boot with the back end located at the above point P1, which is a midway point in the heel 8, and with the front end located at the above point P2 of the toe section, and (ii) is constructed for attachment therein of the fastener 20 by positioning a frontal engagement component 21 of the fastener 20 slightly behind the toe 6, and a rear engagement component 27 in the heel 8. In addition, the attached fastener 20 is held in position such that it is not exposed towards the outside of the bottom contact surface by inserting the entire fastener towards the center from the bottom contact surface. As shown in FIG. 5, the above plate sole 5 is used for attaching the fastener 20, and is constructed in a manner that tightens and fixes the fastener 20 by the force of tightening attachment screws 22 and 23, and nuts **22*a* and 23*a* which have a structure that passes through the fastener 20**.

Figure 6:
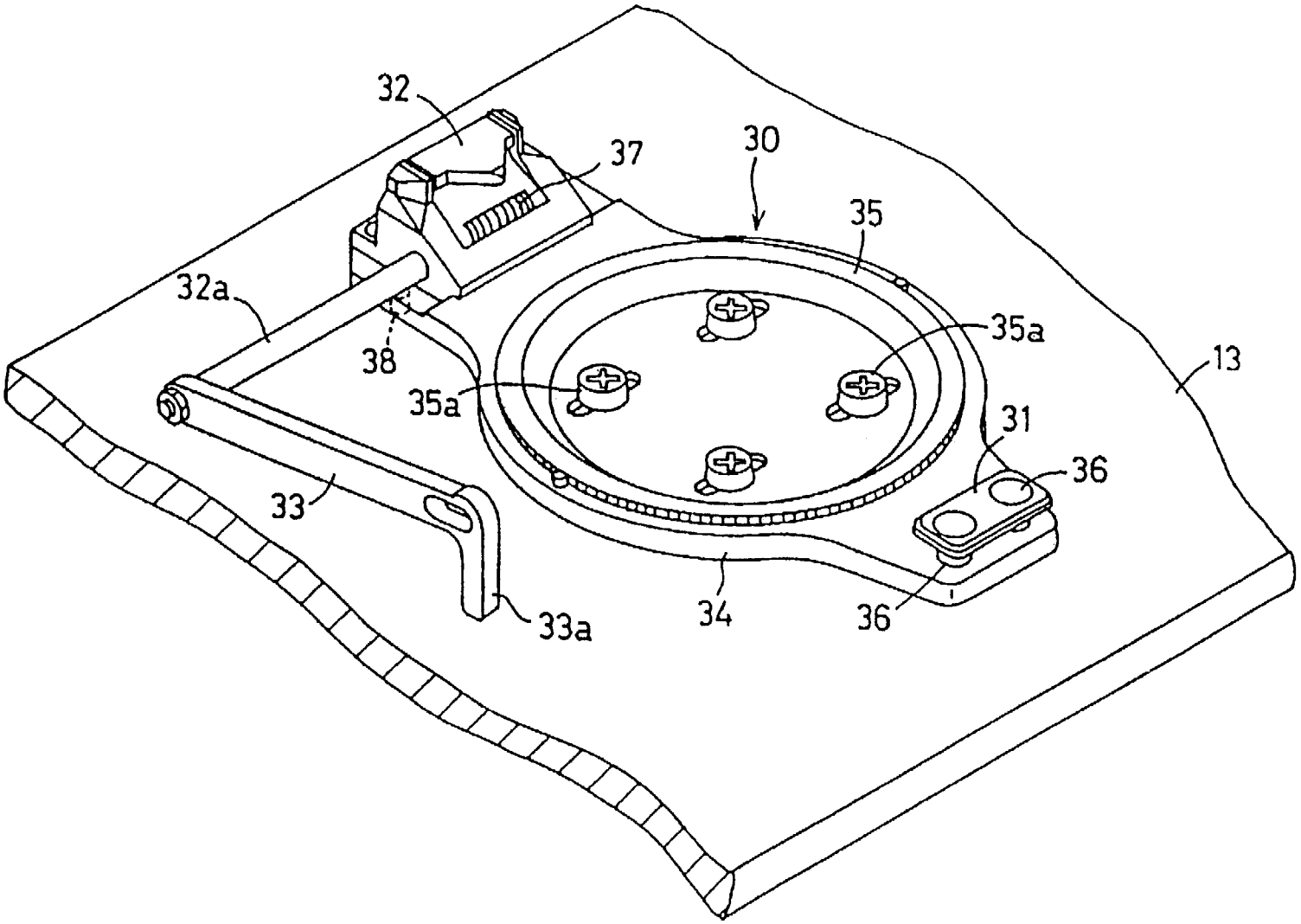
FIG. 6 is an oblique view of a particular embodiment of a snowboard binding used with the snowboard boot according to the present invention.

As shown in FIGS. 5 and 6, the above binding 30 is constructed by employing a presser member 35, wherein this presser member utilizes (I) a front fastener 31 that acts on the frontal engagement component 21 of the fastener 20, (ii) a rear fastener 32 that acts on the rear engagement component 27 of the fastener 20, and (iii) a base member 34 that is equipped with a lock release lever 33, and wherein this presser member presses down on and fixes the base member 34 to the snowboard 13 by means of an attachment screw **35*a*, which tightens and attaches the base member 34 to the snowboard 13 when the base member 34 is mounted over a circular attachment hole 34*a* located between the two fasteners 31 and 32 of this base member 34**.

More specifically, the front fastener 31 is fixed the base component 34 as a result of the tightening force of (I) a pair of left and right positioning nuts 36 and 36, which are structured to separately tighten the two ends of this front fastener 31, and (ii) an attachment screw (not illustrated), which is structured to tighten both of the nuts 36 and 36 to the base member 34. The tip of the frontal engagement component 21 of the fastener 20 is inserted from the rear of the binding 30 between the positioning nuts 36 and 36. The frontal engagement component 21 is prevented from moving from its preset position, either towards the front or the sides of the boot by means of the engagement of the positioning nuts 36 as a result of the frontal engagement component 21 assuming the preset position for attachment, due to the positioning action of the positioning nuts 36 when the base end of the frontal engagement component 21 comes into contact with the positioning nuts 36. The frontal engagement component 21 of the fastener 20 is attached to the binding 30 by means of the engagement of the front fastener 31 which prevents the frontal engagement component 21 from being dislodged towards the upper side of the snowboard from its preset position for attachment.

The rear fastener 32 of the binding 30 (I) is oscillatingly attached to the base member 34 by means of a rotating spindle **32*a*, and (ii) having an attachment position that engages such that it is not dislodged to the back or front sides of the boot, nor to the upper side of the snowboard 12 with respect to the rear engagement component 27, and (iii) able to oscillate to the attachment release position from this attachment position to the back side of the binding, as well as (iv) being energized in the attachment position by means of a lock spring 37. A rear engagement component 27 of the fastener 20 is equipped with an inclined cam component (not illustrated), which enables the engagement of the rear engagement component 27 to the rear fastener 32 while the rear fastener 32 resists the lock spring 37 and oscillates and pushes into the attachment release position, and thus results in the rear engagement component 27 of the fastener 20 to automatically attach to the rear fastener 32 when the rear engagement component 27, of the fastener 20, after attaching the frontal engagement component 21 to the binding 30, is mounted on the rear fastener 32 and the boot is snapped down into place. Following this attachment, the rear engagement component 27 drops into place between the rear fastener supports which are located to the left and right of the rear fastener 32. These left and right fastener supports come into contact with the rear engagement component 27 and prevent the rear engagement component 27** from moving to the right or left.

The rear fastener 32 does not oscillate towards the back or lose its attachment despite the force of an action that pushes up on the rear fastener 32 from the rear engagement component 27 due to a lifting up motion of the heel, and the like, because of the positional relationship of the rotating spindle **32*a* of the rear fastener 32 and the rear engagement component 27. Consequently, both the frontal engagement component 21 and the rear engagement component 27 of the fastener 20, are attached to the binding 30. At this time, the rotating spindle 32*a* of the rear fastener 32 rotates due to the oscillation of the rear fastener 32, and this results in the flat surface area, which is provided close to the point where it is supported by the base member 34 of the rotating spindle 32*a*, is facing opposite a lock pin 38, which is attached to the base member 34. This results in the lock pin 38 engaging with the above flat surface area due to the projecting energizing force of a lock spring (not illustrated), and causing a rotating lock on the rotating spindle 32*a*. This results in locking the rear fastener 32** into attachment position.

The above lock release lever 33 is attached to the above rotating spindle **32*a* for integrated rotation. This results in a free end 33*a* of the lock release lever 33 to automatically assume the lock position which comes into contact with the upper surface of the snowboard 13. Consequently, by oscillating the lock release lever 33, which is located in this lock, in a manner which resists (I) the lock spring which acts on the above lock pin 38 towards the back side of the binding 30 in the area around the axis center of the rotating spindle 32*a*, and (ii) the lock spring 37 which acts on the rear fastener 32, this lock release lever permits the switching of the rear fastener 32 from the attachment position to the attachment release position. During this switching, the rear engagement component 27 of the fastener 20 is released from the rear fastener 32 of the binding 30, then the frontal engagement component 21 of the fastener 20 is released from the front fastener 31 of the binding 30, and as a result, the fastener 20 can be released from the binding 30**.

The attachment strength of the fastener 20 is achieved by utilizing attachment screws 22 and 23 for attaching the fastener 20 to the depression 10 of the sole 3, and by utilizing the plate sole 5 to serve as the attachment plate that exerts a reinforcement action on the sole 3 in order to provide attachment strength. As a result of attaching the fastener 20 to the binding 30 at the front and back ends of the sole 3, the sole 3 is attached to the snowboard 13 in a manner that permits efficient manipulation in leaning the snowboard 13 to the left and right in order for the edges of the snowboard 13 to act on the snow surface. For example, therefore, in the same manner that even the manipulation force on the side of the heel, which is the lifting up side when the motion of the legs is intended to lean the snowboard 13 to the left or right so that the toe side is the pressing down side and the heel side is the lifting up side, is efficiently transferred into a lifting up manipulation force on the snowboard 13, the attachment provides for an equally efficient transfer of the manipulation force on both the toe side and the heel side to the snowboard 13. The execution of this attachment operation enables the use of an attachment method for attaching the front fastener 31 and the frontal engagement component 21 wherein (I) the toe 6 is positioned further towards the back of the binding than the front fastener 31 of the binding 30, (ii) then the sole 3 which is mounted on the binding 30 is moved frontally, (iii) and the front fastener 31 of the binding 30 passes through the space 12 to the recessed groove 11 and placed into depression 10. During this operation, due to the upwardly bent back design of the toe 6, this toe easily bypasses the front fastener 31 of the binding 30, allowing the front fastener 31 to easily snap into the depression 10.

Furthermore, this boot is a boot for attaching the snowboard 13 by means of the fastener 20 and the binding 30, and in addition, by utilizing a fastener for attaching the snowboard 13 at the front and back sides of the boot as the fastener 20, this boot can be advantageously attached or released from the snowboard 13. Specifically, along with a simple attachment operation for attaching the boot to the snowboard 13 merely by placing the fastener 20 in contact with the binding 30 and executing a stepping down motion, such as when mounting/dismounting a ski lift, boot attachment and release is also made simple by a mere manipulation of the lock release lever 33. In the case of a boot that utilizes a buckle type of binding, the heel side readily lifts away from the snowboard 13, and discomfort easily sets in on the buckled in foot, as well. However, in contrast to this, the boot pertaining to the above example utilizes a fastener 20 for attaching the snowboard at the from and back sides of the boot, and thus the heel side and the toe side do not ready lift away, and in addition, the force for attaching the snowboard and the boot is also the force for keeping the foot fled in. In this aspect, as well, the snowboard can be manipulated with enjoyment and efficiency.

When walking with the snowboard detached, walking is easy as a result of having the fastener 20 placed into the depression 10 which makes it difficult for this fastener to come into contact with the ground, as well having the elastic outer sole 4 provide a cushioning action when coming into contact with the ground. Walking is facilitated further as a result of the upward bent design of the toe 6 which causes the easy lifting up of the heel side from the ground.

As shown in FIG. 2, the plate sole 5 is formed by the placement of the front end 5*a* of the above plate sole 5 in a location further back from the above recessed groove 11 at the back end of the boot, and a bottom 3*a*, wherein is located the recessed groove 11 and the toe 6 within the sole 3, is formed to be more bendable and distortable than other bottoms 3*b* that have the plate sole 5 by not having the plate sole 5. Specifically, walking is easy as a result of the readily bendable toe side when a lifting up force is applied to the heel side in walking, which then facilitates the lifting up of the heel side.

Figure 7:
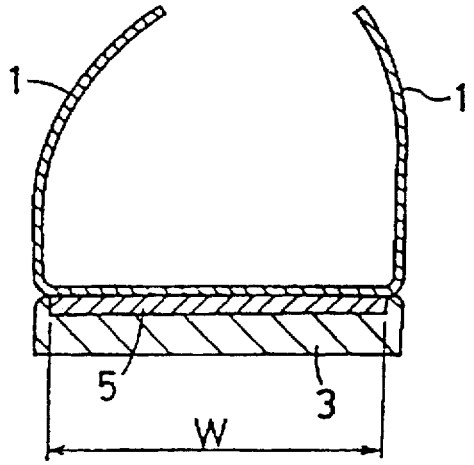
FIG. 7 is a cross-sectional view of a snowboard boot illustrating a method of attaching an upper to the sole.
Figure 8:
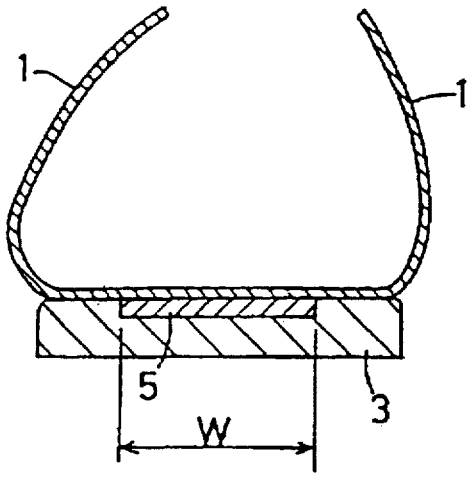
FIG. 8 is a cross-sectional view of a snowboard boot illustrating another method of attaching the upper to the sole.

As shown in FIG. 7, in the cross-sectional view of the boot, the upper 1 is constructed to extend upwardly from the vicinity of the lateral ends of the plate sole 5 along both ends of the sole 3. Specifically, as shown in FIG. 8, if the upper 1 stretches upwardly while facing outwardly from a lateral width W of the plate sole 5 along both end of the sole 3, then in the cross-sectional view of the boot, the upper 1 becomes a curved shape with exterior swelling. In this case, if the force from the pulling action resulting from the force to lift the leg in order to lift the snowboard 13, acts on the upper 1, then the upper 1 will be extended into a straight line from a curved state as a result of this force. At which time, the sole 3 will be difficult to lift due to the extension of the upper 1, and the snowboard 13 will be rendered difficult to lift to the same degree. In contrast to this, if the upper 3 is stretched in a direction facing straight up from a lateral-end point, or in the vicinity thereof, of the plate sole 5, then the upper 1 will extend in a straight line from the beginning without curving by the exterior swelling. For this reason, if the pulling action force resulting from the force to lift up the leg acts on the upper 1, then the sole 3 is lifted efficiently, and the snowboard 13 is also lifted easily. Specifically, the snowboard 13 can be efficiently manipulated to be lifted. This action and effect can be achieved by means of a structure wherein the upper 1 is constructed to extend in a direction facing straight up from a lateral-end point of the plate sole 5, in addition to constructing the upper 1 to extend in a direction facing up more from the inside than from a lateral-end point of the sole plate. Specifically, the upper 1 does not protrude from the sole 3 towards the exterior of the sole plate 5 from the sole 3, in order to achieve this action and effect, but is constructed to extend with a width that is equal to the sole plate 5, or a width that approximates this.

As shown in FIGS. 1 and 2, as a result of positioning the heel 8 towards the back of the sole 3, which position is further to the back than the position located in boots in general, a laterally facing space 14 is formed in the direction of the exterior lateral sides of the boot to the left and right sides of a point positioned further back than the non-contact part 9 of the sole 3. In addition, this laterally facing space 14 to the left and right sides, is formed to pass through to the back end of the above depression 10. Specifically, when snow packs into the depression 10, the sole 3 is shaken to the left and right with the sole 3 positioned above the binding 30. At which point, the snow is pushed out from the laterally facing space 14 to the left and right by the rear fastener 32 of the binding 30, and thus snow can be removed from the depression 10 without removing the boot or using the hands.

While the above is a description of various embodiments of the present invention, further modifications may be employed without departing from the spirit and scope of the present invention. For example, in the above embodiments the present invention can be applied for fasteners in boots (I) wherein the boot is structured by means of utilizing a single-part type of fastener with the frontal engagement component attached to the binding at the front of the boot, and the rear engagement component attached to the binding at the back of the boot, presented as one fastener, and (ii) wherein the boot is structured by means of utilizing a several-pans type of fastener comprising a from fastener equipped with a frontal engagement component, and a rear fastener equipped with a rear engagement component, presented as two fastener pans.

The present invention also can be applied for plate soles in boots (I) wherein the boot utilizes a short type plate sole whose front end does not reach the toe, and (ii) wherein the boot utilizes a long type plate sole whose front end does reach the toe. To serve as these plate soles, it is acceptable to use metal plate soles, such as stainless steel, as well as those of plastic fabrication.

Thus, the scope of the invention should not be limited by the specific structures disclosed. Instead, the true scope of the invention should be determined by the following claims. Of course, although labeling symbols are used in the claims in order to facilitate reference to the figures, the present invention is not to be limited to the constructions in the appended figures by such labeling.

What is claimed is:

1. A snowboard boot comprising:

a sole (3), wherein the sole (3) includes:

a depression (10) defined therein for attachment of a fastener (20);

a recessed groove (11 ) for providing a space (12) which opens to the front of the boot for creating a through-passage between the space (12) and the depression (10);

a toe portion (6) disposed forwardly of the recessed groove (11 );

wherein a portion of the sole (3) which includes the toe portion (6) and recessed groove (11) is more resilient than a remaining portion of the boot;

a reinforcement plate (5) for attachment of the fastener (20); and wherein the reinforcement plate (5) is disposed in portions of the sole (3) except the portion of the sole (3) which includes the toe portion (6) and recessed groove (11).

2. The boot according to claim 1 further comprising an upper (1) having first and second panels extending upwardly from lateral sides of the sole (3), wherein a width between the first panel and the second panel is approximately equal to a lateral width of the reinforcement plate (5).

3. The boot according to claim 1 wherein the toe portion (6) of the boot bends upwardly.

4. The boot according to claim 3 further comprising the fastener (20) attached to the reinforcement plate (5).

5. The boot according to claim 4 wherein the fastener comprises:

an elongated intermediate portion;

a frontal engagement component (21) disposed on a front end of the intermediate portion for engagement with a front fastener (31) on the snowboard; and a rear engagement component (27) disposed on a rear end of the intermediate portion for engagement with a rear fastener (32) on the snowboard.

6. The boot according to claim 1 wherein the sole defines laterally extending portions of the depression (10) for forming lateral openings in the sole (3).

* * * * *